United States Patent [19]

Pocrnja et al.

[11] 4,377,073

[45] Mar. 22, 1983

[54] METHODS FOR CONVERTING HEAT INTO MECHANICAL ENERGY AND/OR USEFUL HEAT

[75] Inventors: Anton Pocrnja, Munich; Martin Streich, Starnberg, both of Fed. Rep. of Germany

[73] Assignee: Linde Aktiengesellschaft, Fed. Rep. of Germany

[21] Appl. No.: 255,172

[22] Filed: Apr. 17, 1981

[30] Foreign Application Priority Data

Apr. 21, 1980 [DE] Fed. Rep. of Germany ..... 3015307

[51] Int. Cl.[3] ..... F28B 7/00

[52] U.S. Cl. ..... 60/693; 60/651; 60/692

[58] Field of Search ..... 60/651, 671, 677, 693, 60/648, 647, 692, 690

[56] References Cited

U.S. PATENT DOCUMENTS

| | | | |
|---|---|---|---|
| 3,731,488 | 5/1973 | Sasakura et al. | 60/693 |
| 3,830,063 | 8/1974 | Morgan | 60/693 |
| 4,164,848 | 8/1979 | Gilli et al. | 60/677 |
| 4,242,870 | 1/1981 | Searingen et al. | 60/671 |

FOREIGN PATENT DOCUMENTS

| | | | |
|---|---|---|---|
| 2120322 | 8/1972 | France | 60/671 |

*Primary Examiner*—A. Michael Chambers

*Attorney, Agent, or Firm*—Lerner, David, Littenberg & Samuel

[57] ABSTRACT

Methods for utilizing the heat content of a heated carrier agent are disclosed including indirectly contacting the carrier agent with a working fluid which boils at a temperature lower than water, in order to vaporize the working fluid, producing mechanical energy by expanding the working fluid to a number of reduced pressures, including the condensation pressure of the working fluid corresponding to atmospheric temperature conditions at the time, and a reduced pressure intermediate between the initial elevated pressure of the working fluid and that condensation pressure, separating the working fluid into separate streams corresponding to the working fluid at each of these reduced pressures, condensing the working fluid stream at the lowest pressure by indirectly contacting it with the atmospheric air, condensing the working fluid at the condensation pressure by indirectly contacting it with a liquid heat carrier, and repressurizing both of those working fluid streams for recycle. In this manner the size of these various working fluid streams determines the amount of the heat content of the heated carrier agent used for producing mechanical energy and/or useful heat therefrom.

4 Claims, 3 Drawing Figures

Fig. 2
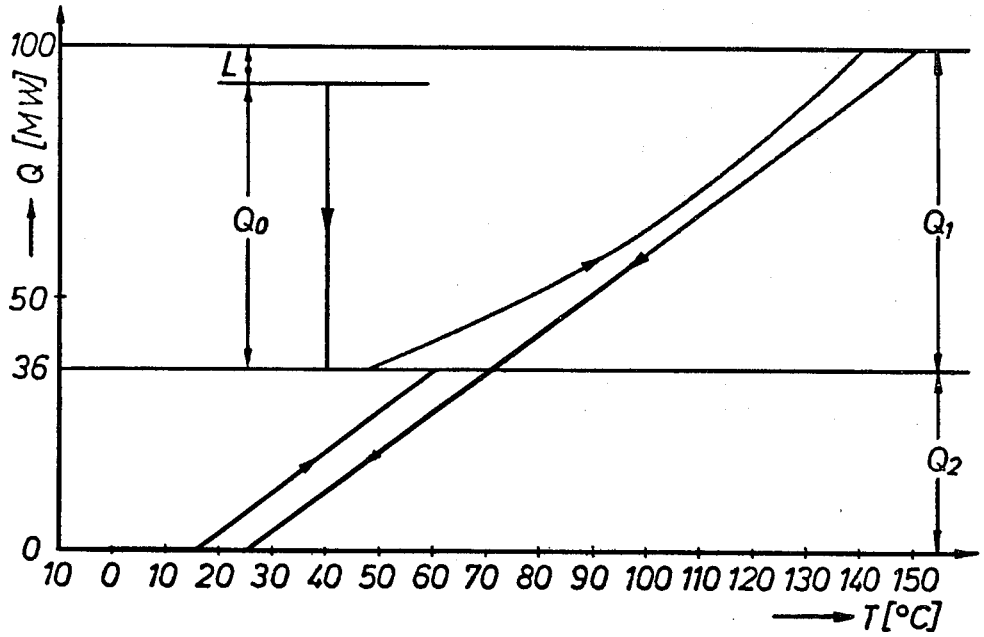
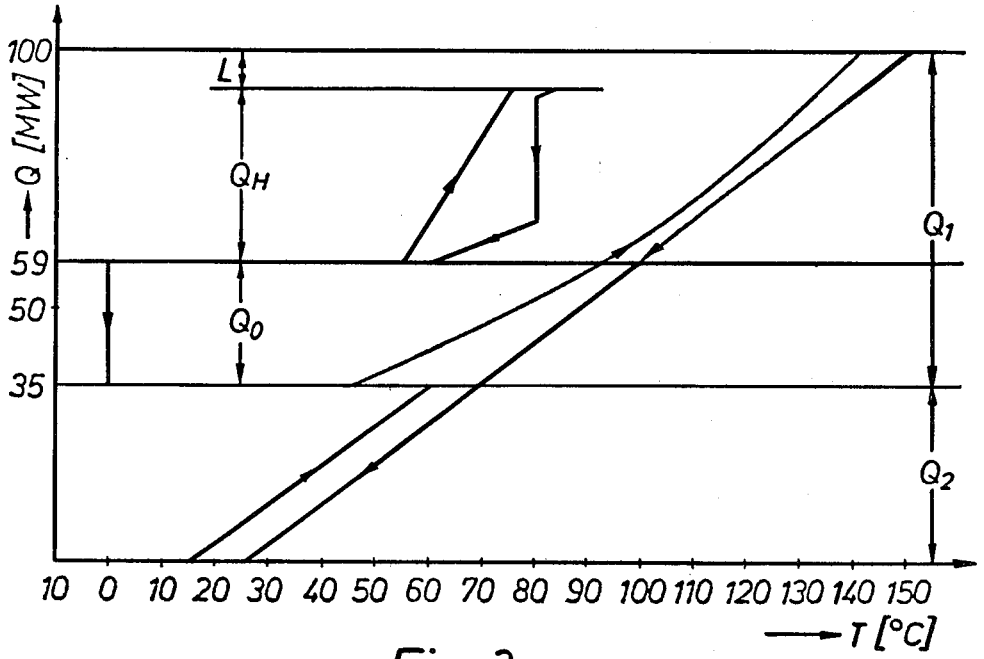
Fig. 3

METHODS FOR CONVERTING HEAT INTO MECHANICAL ENERGY AND/OR USEFUL HEAT

FIELD OF THE INVENTION

The present invention relates to methods for converting heat into mechanical energy and/or useful heat in a closed circulation system. More particularly, the present invention relates to such methods in which a working agent is heated, expanded, liquified, and raised to a specified pressure therein.

BACKGROUND OF THE INVENTION

In typical heating plants the heat is generally supplied in an open circulation system in which air is compressed and fed to a burning chamber where it is burned with a specified fuel. The resultant high pressure and high temperature gases are then expanded in a gas turbine, and the remainder of the heat is then fed for use in a heat exchanger such as waste heat boiler. In these heat exchangers, this heat is then used for the evaporation of water, which then circulates in a closed circulation system. The steam thus created is expanded in a condensation steam turbine to a condensation pressure of about 0.04 bar, for example, is then condensed with cooling water in a heat exchanger, and then again pumped to the heat exchanger. For use in heating, the steam can then be taken from the steam turbine and again condensed with a heat carrier such as hot water.

In heating plants of this type the supplied heat is not efficiently used with variations in temperature. Furthermore, the extraction of heat from the steady circulation generally inadvertently leads to an increased cost in the production of mechanical energy.

It is therefore an object of the present invention to convert heat in such a method in which heat can be supplied without having to necessarily decrease the portion of that heat which is converted into mechanical energy.

SUMMARY OF THE INVENTION

In accordance with the present invention, these and other objects have now been met by a system in which a working fluid or agent is employed which boils at a temperature lower than that of the boiling point of water, and which is expanded to at least two different pressure levels. It has thus been discovered that the heat content of a heated carrier agent can thus be utilized in a closed circulation system, and in response to variations in predetermined atmoshperic temperatures, for the production of mechanical energy and/or useful heat, by indirectly contacting the heated carrier agent with a working fluid having a boiling point lower than that of water which is maintained at a predetermined elevated working fluid pressure, thereby vaporizing the working fluid, producing mechanical energy by expanding the working fluid to first and second reduced pressures, the first reduced pressure being the condensation pressure of the working fluid corresponding to the predetermined atmospheric temperature, and the second reduced pressure being an intermediate pressure between the predetermined elevated working fluid pressure and the condensation pressure, separating the working fluid into first and second working fluid streams corresponding to the working fluid expanded to these first and second reduced pressures, respectively, condensing the first working fluid stream by indirect contact with the atmosphere at the predetermined atmospheric temperature, condensing the second working fluid stream by indirect contact with a liquid heat carrier so as to produce useful heat therefrom, and pressurizing both the first and second working fluid streams to the predetermined elevated working fluid pressure for reuse (recycle) thereof.

In the case where water is used as a working fluid or circulation material, a relatively constant condensation temperature must be maintained because the steam pressure of the water in the area of the expansion pressure of the steam turbine sharply decreases with lower condensation temperatures. On the other hand, the volume of escaping steam from the turbine increases, but this is true only for a specifically designed output volume, which is greatly exceeded when the condensation temperature is decreased by about 10° or 20° C. Furthermore, even lower condensation temperatures cannot be realized because of the danger of freezing.

Therefore, in typical heating plants one has to maintain a relatively constant condensation temperature during operation in the summer months, as well as during winter operation. In the summer, where very little use of heating water is required, one can maintain the total amount of circulating water, i.e., the amount of steam expanded to the lowest pressure of approximately 0.04 bar, and therefore realize a maximum of mechanical energy output. In this manner, the amount of energy decreases as the demand for heating water increases, i.e., during winter operation.

It is therefore advantageous in accordance with this invention to employ a working agent or fluid which boils at a temperature lower than that of water. The steam pressure of such a working agent fluctuates less than that of water in the area of the surrounding temperature. By using such a working agent, the condensation temperature therefore does not have to be maintained above a specified value, but lower condensation temperatures now become extremely advantageous. It is therefore quite favorable to condense the working agent in a heat exchanger with air at the temperature of the surroundings as the cooling substance therein. Since in the winter this air temperature will be quite low, and can thus be at temperatures below the freezing point of water, in accordance with this invention one can then supply additional useful heat, as for heating, at this time of year without any reduction of unused mechanical energy, or with the production of more mechanical energy as compared to operation during the summer months. That is, by substantial compensation of the condensation temperature of the working agent with respect to the temperature of the outside air, lower condensation pressures for the working agents are realized during the winter months than is the case in the summer. Thus, if it is necessary to produce heat, the present invention provides for the expansion of smaller amounts of the working agent to the condensation pressure (again as compared to summer operation), with the remaining amount of the working agent being removed at a higher pressure from the expansion turbine to be used for the heating of a heat carrier, such as heating water. During such variations, the portion of mechanical energy produced per unit of time does not change. Since the amount of working agent expanded to the lowest possible pressure decreases, the volume thereof remains relatively constant because of the lower condensation pressures. Thus, the principal difference between the operation of typical heating plants and that of the proposed method of this invention is in the use made of temperature drops of the air during the winter months, whereby the relationship of the used heat converted into mechanical energy and that used for useful heating varies within wide limits.

In accordance with one embodiment of the present invention, the predetermined elevated working fluid pressure for the working agent is a super-critical pressure for the working fluid prior to use of the heat exchanged thereinto for production of both mechanical energy and/or useful heat. Based upon the characteristic curves of the enthalpy as a function of temperature, the temperature difference between the working fluid which is to be heated and the heat released from the system can be substantially reduced, and the exergy loss during heat exchange is therefore reduced to a minimum.

In accordance with another embodiment of the present invention the working fluid is expanded to several different pressure levels, including the condensation pressure of the temperature of the surrounding atmosphere, and is separated at several places from the expansion turbine. Apart from the partial stream which is maintained at the lowest pressure (or condensation pressure) the other partial streams separated from the expansion turbine, in the order of their increasing pressure levels, are brought into contact with a liquid heat carrier such as water in the heat exchanger, whereby the separate partial streams condense.

The proposed method of the present invention is particularly suited to the use of low or medium temperature heat whereby the amount of low temperature heat is expanded to a temperature of approximately 150° C. and the amount of medium temperature heat is expanded to a temperature of between approximately 150° and 450° C. The present method thus maintains it advantages in converting, for example, thermal water or warm gases and liquids within a given temperature range, and applies to the available heat at changing temperatures. As the working fluid, a paraffinic hydrocarbon is quite suitable for use herein, particularly one which includes from 3 to 6 carbon atoms, or a comparable halogenated hydrocarbon.

One can thus conclude that by adjusting the condensation temperature to the temperature of the outside air according to the present invention the conversion of heat into mechanical energy is increased, i.e., the removal of large amounts of heat can be achieved without reducing the portion of heat used for producing mechanical energy as in the case of operation during the summer months. By employing this invention, in addition to being able to adjust the temperature of the working fluid and of the heat carrier, economical usage of the various heat streams with relatively low starting temperatures is insured.

BRIEF DESCRIPTION OF THE DRAWINGS

The present invention is more fully described with reference to the following schematic drawings of a particular example thereof, in which

FIG.2 is a graph respecting the amount of heat versus temperature for a particular embodiment of the present invention; and FIG. 3 is a graph representing the amount of heat versus temperature for another embodiment of the present invention.

DETAILED DESCRIPTION

Figure 1:
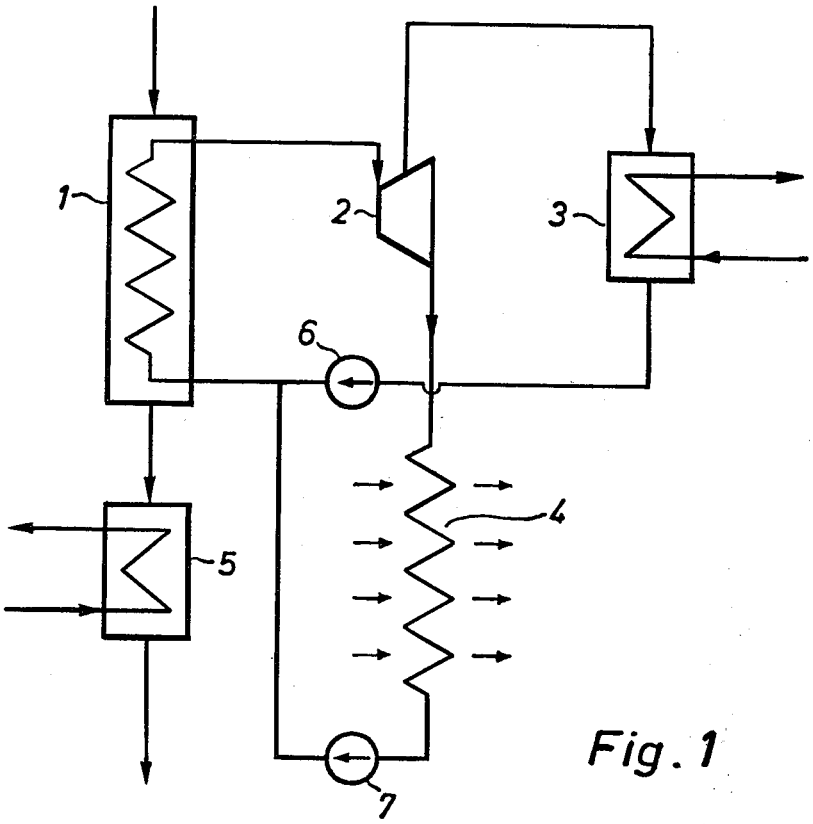
FIG. 1 is a schematic drawing of the method of the present invention.

Referring to the figures, FIG. 1 shows a heated carrier, heated for example to a temperature of about 150° C., which is fed through a pipe 8 into heat exchanger 1 where it is substantially cooled. However, heat which is not removed from the heated carrier in heat exchanger 1 can be removed in an additional heat exchanger 5, where the heat can be used, for example, for heating utility water so that the heated carrier is then cooled to a temperature of approximately 25° C. thereafter. In the heat exchanger 1 a working agent or fluid is employed which is maintained at a super-critical pressure, and in the particular example shown propane having a pressure of 80 bar is utilized, and is heated to a temperature of approximately 140° C. for subsequent expansion in turbine 2 to a condensation pressure $P_0$ at the temperature of the surrounding atmosphere. In addition to a partial stream $G_0$ expanded to the pressure $P_0$, an additional partial stream $G_1$ at a higher pressure $P_1$ is also removed from the turbine 2. This partial stream $G_1$ is fed to another heat exchanger 3. In heat exchanger 3 the exchange of heat with heating water is conducted, and an amount of heat $Q_h$ is extracted from this partial stream so that the propane condenses, and wherein it can thereafter be repressurized to the super-critical pressure in a pump 6. The partial stream $G_0$ removed from turbine 2 is fed to an air cooled condenser 4. In this condenser 4 an amount of heat $Q_0$ is extracted from the propane so that it condenses therein. The liquid propane at the pressure $P_0$ is then also brought up to the super-critical pressure by means of pump 7, and this pressurized stream can then be combined with the partial stream $G_1$ also under super-critical pressure, and again fed to heat exchanger 1.

In accordance with this circulation process, the available heat can be used differently with changing temperature conditions depending on the time of year. Thus, during summer operation (Case 1) the heat absorbed during circulation can be used exclusively for the production of mechanical energy, and the remaining energy removed therefrom in heat exchanger 5 can then be used for heating utility water. This case is shown in FIG. 2, where curve 9 corresponds to the heat content of the heated carrier, which is cooled from 150° C. in heat exchanger 1 with propane (see curve 10) to a temperature of approximately 70° C., and which thereafter is cooled with utility water (see curve 11) to a temperature of about 25° C.

As can be seen from the shape of the curve in FIG. 2 only small temperature differences exist between the propane under super-critical pressure (80 bar) and the heated carrier. Therefore, heat exchange is achieved without great exergy losses. The heated carrier gives off an amount of heat to the propane per unit of time $Q_1$ of 64 MW, whereby the heat remaining for heating the utility water is only about 36 MW ($Q_2$). The propane which has thus been heated and is under a super-critical pressure is then released only to a condensation pressure $P_0$ of 13.7 bar, and condensed in the heat exchanger 4 with air at a temperature of about 40° C. The condensation of the propane corresponds to curve 12 in FIG. 2 where $Q_0$ is 56.61 MW, which is the amount of heat dissipated to the air therein.

During winter operation (case 2) the heat removed from the heated carrier can be used not only for conversion into mechanical energy and for heating utility water in heat exchanger 5, but can also be used for the heating of heating water, i.e., in heat exchanger 3. In view of decreasing outside or atmospheric temperatures the condensation temperature in condenser 4 decreases, so that during circulation more mechanical energy can be produced, or with the production of the same amount of mechanical energy in comparison to summer operation, more heating can be supplied. This is shown in FIG. 3. Thus, at an air temperature of about 0° C., which is assumed in connection with FIG. 3, the propane is released to the lowest pressure condensate at a temperature of 0° C. and a pressure of 4.8 bar. Since part of the propane is thus released to a lower condensation pressure as compared to summer operation, additional heating (about 34.17 MW) can be supplied at an equal net efficiency L to that of summer operation (6.78 MW). In this case about 462,100 kg/h of propane ($G_1$) can be removed at a pressure of 31 bar where the total flow rate of circulation is, for example, 698,500 kg/h where the heat exchanger 3 is brought into contact with heating water, while the rest of the propane $G_2$ (236,400 kg/h) is released at a condensation pressure $P_0$ of 4.8 bar. In pump 7 this portion of the propane is again pumped up to the super-critical working pressure, and together with the amount of propane $G_1$ liquified by the heating water is fed back to heat exchanger 1. The lower the outside or atmospheric temperature the more heating which can be supplied at constant energy production. The volume of the decreasing amount of propane $G_0$ stays substantially constant at decreasing outside temperatures. In the heat exchanger 3 a heat circulator can, for example, be heated up to about 55° to 75° C. Curves 14 and 15 in FIG. 3 again show the heat exchange occurring between the propane under a pressure of $P_1$ of 31 bar and the heating water. From this heating water a corresponding amount of heat $Q_h$ of 34.17 MW is absorbed per unit of time. Curve 13 corresponds to the amount of heat absorbed by the propane condensed at 4.8 bar ($Q_0$=23.87 MW). Data relating to the circulation process of FIG. 1 during both summer and winter operations (Cases 1 and 2) are gathered in Table 1. In addition, also included in Table 1 are additional data for two additional methods of operation. That is, in Case 3, data is shown for a circulation process during winter operation in which maximum energy output is obtained. In Case 4 the circulation process is shown which is designed for a supply of a maximum amount of heat during winter operation. Having thus described the present invention, the invention is in no way intended to be limited thereby and is subject to many modifications and variations thereof.

TABLE 1

| | | | Case 1 | Case 2 | Case 3 | Case 4 |
|---|---|---|---|---|---|---|
| Heat output/$_t$ by cooling from 150–25° C. | | (MW) | 100 | 100 | 100 | 100 |
| Absorbed heat/$_t$ $Q_1$ absorbed by the circulation | | (MW) | 64 | 65.0 | 85.6 | 54.5 |
| $C_3H_8$ | Removed for heating | 1 | | 462 100 | | 698 500 |
| Circulation | Rate of flow in the condensator | $G_0$ | 698 500 | 236 400 | 698 500 | |
| (kg/h) | Total rate of flow in the circulation | G | 698 500 | 698 500 | 698 500 | 698 500 |
| Circulation pressure | $p/p_1/p_0$ | (bar) | 80/—13.8 | 0/31/4.8 | 80/—/4.8 | 80/31/— |
| Circulation | Maximum temperature | (°C.) | 140 | 140 | 140 | 140 |
| temperature | Heating water temperature | (°C.) | | 83–80–60 | | 83–80–60 |
| Condensation temperature | (°C.) | 40 | 0 | 0 | 0 | |
| Turbine output | $(q_1 = 0.85)\ L_T$ | MW | 10.56 | 9.70 | 18.19 | 5.36 |
| Internal | Pump output ($q_1$ = 0.85) | $L_p$ | 3.17 | 2.74 | 3.17 | 2.52 |
| Energy loss | Output of the blower application | | | | | |
| (MW) | Δdir. = 10° Δp = 10 mm WS | $L_V$ | 0.61 | 0.18 | 0.54 | |
| Efficiency (net) | L | (MW) | 6.78 | 6.78 | 14.48 | 2.84 |
| Amount of heat/$_t$ | $Q_h$ | (MW) | | 34.17 | | 51.66 |
| Residual heat for utility water/$_t$ $Q_2$ | | (MW) | 36 | 35 | 14.4 | 45.5 |
| Waste heat in the condensator/$_t$ $Q_0$ | | (MW) | 56.61 | 23.87 | 70.58 | |

What is claimed is:

1. A method of utilizing the heat content of a heated carrier agent in response to variations in predetermined atmospheric temperatures comprising indirectly contacting said heated carrier agent with a working fluid having a boiling point lower than that of water, said working fluid being maintained at a predetermined elevated working fluid pressure, thereby vaporizing said working fluid, producing mechanical energy by expanding said working fluid to first and second reduced pressures, said first reduced pressure comprising the condensation pressure of said working fluid corresponding to said predetermined atmospheric temperature, and said second reduced pressure comprising an intermediate pressure between said predetermined elevated working fluid pressure and said condensation pressure, separating said working fluids into first and second working fluid streams comprising said working fluids expanded to said first and second reduced pressures, respectively, condensing said first working fluid stream by indirect contact with the atmosphere at said predetermined atmospheric temperature, condensing said second working fluid stream by indirect contact with a liquid heat carrier so as to produce useful heat therefrom, and pressurizing said first and second working fluid streams to said predetermined elevated working fluid pressure.

2. The method of claim 1 wherein said working fluid comprises a hydrocarbon selected from the group consisting of paraffinic and halogenated hydrocarbons including from about 3 to 6 carbon atoms.

3. The method of claim 1 wherein said predetermined elevated working fluid pressure comprises a super-critical pressure for said working fluid.

4. The method of claim 1 wherein said working fluid is expanded to a plurality of reduced pressures including at least two intermediate pressures between said predetermined working fluid pressure and said condensation pressure, so as to produce a plurality of said second working fluid streams, including condensing each of said second working fluid streams by indirect contact with said liquid heat carrier so as to produce useful heat therefrom, and pressurizing said plurality of second working stream to said predetermined elevated elevated working fluid pressure.

* * * * *

UNITED STATES PATENT AND TRADEMARK OFFICE

CERTIFICATE OF CORRECTION

PATENT NO. : 4,377,073

DATED : Mar. 22, 1983

INVENTOR(S) : Pocrnja et al.

It is certified that error appears in the above-identified patent and that said Letters Patent are hereby corrected as shown below:

Columns 5 and 6, line 7,

"$C_3H_8$ Removed for heating 1 462 100 698 500"

should read

--$C_3H_8$ $C_3C_8$ Removed for heating G1 462 100 698 500--.

Columns 5 and 6, lines 12 and 13,

"temperature Condensation temperature" Heating water temperature (°C.) (°C.) 83-80-60 40 0 0 0 83-80-60 should read

--temperature Heating water temperature (°C.) Condensation temperature (°C.) 83-80-60 40 0 0 83-80-60 0--.

Signed and Sealed this

Fourteenth Day of June 1983

[SEAL]

Attest:

DONALD J. QUIGG

Attesting Officer

Acting Commissioner of Patents and Trademarks